US010760141B2

(12) United States Patent
Joo et al.

(10) Patent No.: US 10,760,141 B2
(45) **Date of Patent: *Sep. 1, 2020**

(54) GRAIN-ORIENTED ELECTRICAL STEEL SHEET AND MANUFACTURING METHOD OF GRAIN-ORIENTED ELECTRICAL STEEL SHEET

(71) Applicant: POSCO, Pohang-si, Gyeongsangbuk-do (KR)

(72) Inventors: Hyung Don Joo, Pohang-si (KR); Hyung-Ki Park, Pohang-si (KR); Jin-Wook Seo, Pohang-si (KR); Kyu-Seok Han, Pohang-si (KR); Jae-Soo Lim, Pohang-si (KR); Hyun-Seok Ko, Pohang-si (KR)

(73) Assignee: POSCO, Pohang-si, Gyeongsangbuk-do (KR)

( * ) Notice: Subject to any disclaimer, the term of this patent is extended or adjusted under 35 U.S.C. 154(b) by 212 days.

This patent is subject to a terminal disclaimer.

(21) Appl. No.: 15/536,254

(22) PCT Filed: Dec. 16, 2014

(86) PCT No.: PCT/KR2014/012409

§ 371 (c)(1),
(2) Date: Jun. 15, 2017

(87) PCT Pub. No.: WO2016/098917

PCT Pub. Date: Jun. 23, 2016

(65) Prior Publication Data

US 2017/0335425 A1 Nov. 23, 2017

(30) Foreign Application Priority Data

Dec. 15, 2014 (KR) ..... 10-2014-0180687

(51) Int. Cl.

| | |
|---|---|
| ***C21D 9/46*** | (2006.01) |
| ***C22C 38/02*** | (2006.01) |
| ***C21D 8/12*** | (2006.01) |
| ***C21D 6/00*** | (2006.01) |
| ***C21D 8/00*** | (2006.01) |
| ***C22C 38/00*** | (2006.01) |
| ***C22C 38/04*** | (2006.01) |
| ***C22C 38/06*** | (2006.01) |

(52) U.S. Cl.

CPC ..... *C21D 9/46* (2013.01); *C21D 6/005* (2013.01); *C21D 6/008* (2013.01); *C21D 8/005* (2013.01); *C21D 8/12* (2013.01); *C21D 8/1222* (2013.01); *C21D 8/1233* (2013.01); *C21D 8/1272* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C21D 2201/05* (2013.01)

(58) Field of Classification Search

CPC .... C21D 6/002; C21D 8/0205; C21D 8/0236; C21D 8/0273; C21D 9/46; C22C 38/00; C22C 38/001; C22C 38/002; C22C 38/004; C22C 38/005; C22C 38/008; C22C 38/02; C22C 38/04; C22C 38/06; C22C 38/20; C22C 38/22; C22C 38/24; C22C 38/26; C22C 38/28; C22C 38/30; C22C 38/32; C22C 38/38; C22C 38/42; C22C 38/44; C22C 38/46; C22C 38/48; C22C 38/50; C22C 38/52; C22C 38/54; C22C 38/60

See application file for complete search history.

(56) References Cited

U.S. PATENT DOCUMENTS

| | | | | |
|---|---|---|---|---|
| 5,885,371 | A | 3/1999 | Komatsubara et al. | |
| 7,887,646 | B2 | 2/2011 | Nanba et al. | |
| 2001/0037841 | A1 | 11/2001 | Murakami et al. | |
| 2009/0047537 | A1 | 2/2009 | Nanba et al. | |
| 2010/0055481 | A1* | 3/2010 | Kubo | C21D 8/1266 428/471 |
| 2015/0294774 | A1 | 10/2015 | Zirlin | |
| 2015/0340137 | A1* | 11/2015 | Hong | C21D 8/12 148/111 |

FOREIGN PATENT DOCUMENTS

| | | | |
|---|---|---|---|
| CN | 103525999 | A | 1/2014 |
| EP | 1580289 | A1 | 9/2005 |
| EP | 1889927 | A1 | 2/2008 |
| EP | 1791985 | B1 | 11/2008 |
| EP | 2708615 | A1 | 3/2014 |
| JP | 64-55339 | A | 3/1989 |
| JP | 01-230721 | A | 9/1989 |

(Continued)

OTHER PUBLICATIONS

International Search Report and Written Opinion dated Jul. 20, 2015, issued in International Application No. PCT/2014/012409. (w/ partial English translation).

(Continued)

*Primary Examiner* — Jenny R Wu

(74) *Attorney, Agent, or Firm* — Morgan, Lewis & Bockius LLP

(57) ABSTRACT

An oriented electrical steel sheet includes Ba at about 0.005 wt % to about 0.5 wt % inclusive, Y at about 0.005 wt % to about 0.5 wt % inclusive, or a composite of Ba and Y at about 0.005 wt % to about 0.5 wt % inclusive, the remainder including Fe and impurities, based on 100 wt % of a total composition of a base steel sheet thereof.

16 Claims, No Drawings

(56) References Cited

FOREIGN PATENT DOCUMENTS

| | | | | |
|---|---|---|---|---|
| JP | 01-283324 | A | | 11/1989 |
| JP | 02-57635 | A | | 2/1990 |
| JP | 10-121135 | A | | 5/1998 |
| JP | 11-043746 | A | | 2/1999 |
| JP | 2000-129356 | A | | 5/2000 |
| JP | 2003-193133 | A | | 7/2003 |
| JP | 2003193133 | A | * | 7/2003 |
| JP | 2004-353036 | A | | 12/2004 |
| JP | 2005-240102 | A | | 9/2005 |
| JP | 2005-264280 | A | | 9/2005 |
| JP | 2005264280 | A | * | 9/2005 |
| JP | 2009-235574 | A | | 10/2009 |
| JP | 2012-087374 | A | | 5/2012 |
| JP | 2012-126973 | A | | 7/2012 |
| KR | 10-2008-0010439 | A | | 1/2008 |
| KR | 2014-0084770 | A | | 7/2014 |
| WO | 2014104444 | A1 | | 7/2014 |

OTHER PUBLICATIONS

"Application Manual of Wear Resistant Materials", Edited by Chen, Huahui, 2nd edition, Mechanical Industry Press, p. 154, Oct. 2012.
Office Action issued in Chinese Patent Application No. 201480084060.4 dated Feb. 11, 2019.
Extended European Search Report issued in European Patent Application No. 14908483.2, dated Nov. 7, 2017.
Japanese Office Action dated Feb. 25, 2020 issued in Japanese Patent Application No. 2019-061364.

* cited by examiner

GRAIN-ORIENTED ELECTRICAL STEEL SHEET AND MANUFACTURING METHOD OF GRAIN-ORIENTED ELECTRICAL STEEL SHEET

CROSS REFERENCE TO RELATED APPLICATION

The present application claims the benefit of priority to International Patent Application No. PCT/KR2014/012409 filed Dec. 16, 2014, which claims the benefit of priority to Korean Patent Application No. 10-2014-0180687, filed Dec. 15, 2014, the entire contents of which are incorporated herein for all purposes by this reference.

TECHNICAL FIELD

The present disclosure relates to an oriented electrical steel sheet and a manufacturing method thereof.

BACKGROUND

Generally, in an oriented electrical steel sheet having excellent magnetic characteristics, a Goss texture of a {110}<001> orientation should strongly develop in a rolling direction thereof, and in order to form such a Goss texture, abnormal grain growth corresponding to secondary recrystallization must be formed. The abnormal grain growth occurs when normal grain growth is inhibited by precipitates, inclusions, or elements that are solidified or segregated, unlike normal grain growth. The oriented electrical steel sheet may be manufactured by a manufacturing method in which a precipitate such as AlN, MnS, or the like is used as a grain growth inhibitor to cause secondary recrystallization. The method of manufacturing the oriented electrical steel sheet by using the precipitate such as AlN, MnS, or the like as the grain growth inhibitor has the following problems. In order to use the AlN and MnS precipitates as the grain growth inhibitor, the precipitates should be distributed very finely and uniformly on the steel sheet. In order to uniformly distribute the fine precipitates to the steel sheet, a slab should be heated at a high temperature of 1300° C. or higher for a long time to solidify coarse precipitates present in steel, and then a hot-rolling process should be performed and finished in a very short time in a state in which no precipitation occurs. For this, a large slab heating system is required, and in order to suppress the precipitation as much as possible, the hot-rolling process and a winding process should be managed very strictly and the precipitates solidified in a hot-rolled steel sheet annealing process after the hot-rolling process should be controlled to be finely precipitated. In addition, when the slab is heated at a high temperature, since a slab washing phenomenon occurs due to formation of $Fe_2SiO_4$ having a low melting point, an actual yield is lowered. Further, a purification annealing process may be performed for a long time at a high temperature of 1200° C. for 30 hours or more in order to remove precipitate components after the completion of the secondary recrystallization, which complicates a manufacturing process and causes a cost burden. Further, in the purification annealing process, after AlN-based precipitates are decomposed into Al and N, Al moves to a surface of the steel sheet and reacts with oxygen in a surface oxide layer to form $Al_2O_3$ oxide. The formed Al-based oxide and the AlN precipitates not decomposed in the purification annealing process interfere with movement of a magnetic domain in the steel sheet or near the surface, thereby deteriorating iron loss.

SUMMARY

An exemplary embodiment of the present disclosure provides an oriented electrical steel sheet including Ba at about 0.005 wt % to about 0.5 wt % inclusive, Y at about 0.005 wt % to about 0.5 wt % inclusive, or a composite of Ba and Y at about 0.005 wt % to about 0.5 wt % inclusive, the remainder including Fe and impurities, based on 100 wt % of a total composition of a base steel sheet thereof.

The base steel sheet thereof may include Si at about 1.0 wt % to about 7.0 wt % inclusive, C at about 0.0050 wt % or less (excluding 0 wt %), Al at about 0.005 wt % or less (excluding 0 wt %), N at about 0.0055 wt % or less (excluding 0 wt %), S at about 0.0055 wt % or less (excluding 0 wt %), and Mn at about 0.01 wt % to about 0.5 wt % inclusive.

An area of grains of the electrical steel sheet having a grain size of about 2 mm or less may be about 10% or less with respect to 100% of an area of total grains.

An average size of grains of the electrical steel sheet having a grain size of about 2 mm or more may be about 10 mm or more.

An angle difference between a <100> plane and a plate plane of the electrical steel sheet may be about 3.5° or less.

$B_{10}$ corresponding to magnetic flux density of the electrical steel sheet measured at a magnetic field of about 1000 Nm may be about 1.88 or more.

The electrical steel sheet may include Ba, Y, or a combination thereof that is segregated at grain boundaries.

Another embodiment of the present disclosure provides A manufacturing method of an oriented electrical steel sheet, including: heating a slab including Ba at about 0.005 wt % to about 0.5 wt % inclusive, Y at about 0.005 wt % to about 0.5 wt % inclusive, or a composite of Ba and Y at about 0.005 wt % to about 0.5 wt % inclusive, and the remaining portion including Fe and other inevitably incorporated impurities, based on 100 wt % of a total composition of the slab; producing a hot-rolled steel sheet by hot-rolling the slab; producing a cold-rolled steel sheet by cold-rolling the hot-rolled steel sheet; performing primary recrystallization annealing for the cold-rolled steel sheet; and performing secondary recrystallization annealing for an electrical steel sheet for which the primary recrystallization annealing is completed.

The slab may include Si at about 1.0 wt % to about 4.5 wt % inclusive, C at about 0.001 wt % to about 0.1 wt % inclusive, Al at about 0.005 wt % or less, N at about 0.0055 wt % or less, S at about 0.0055 wt % or less, and Mn at about 0.01 wt % to about 0.5 wt % inclusive.

A slab heating temperature in the heating of the slab may be about 1280° C. or lower.

A soaking temperature in the secondary recrystallization annealing may be about 900° C. to about 1250° C.

After the hot-rolling, hot-rolled steel sheet annealing may be performed.

In the primary recrystallization annealing, the cold-rolled steel sheet may be maintained at a temperature of 750° C. or higher for about 30 seconds or more.

DETAILED DESCRIPTION

The oriented electrical steel sheet according to embodiments of the present disclosure has low iron loss and excellent magnetic characteristics by stably forming Goss grains.

In addition, since AlN and MnS are not used as the grain growth inhibitor, it is unnecessary to reheat the slab at a temperature higher than 1300° C.

Further, since high temperature purification annealing for removing precipitates such as AlN and MnS is not required, manufacturing costs are reduced.

Further, since there is no need to remove nitrogen (N), sulfur (S), or the like after the high temperature annealing process, there is no surface defect due to a gasification reaction with N and S in the high temperature purification annealing process.

The present disclosure has been made in an effort to provide an oriented electrical steel sheet.

The present disclosure has also been made in an effort to provide a manufacturing method of the oriented electrical steel sheet.

The advantages and features of the present disclosure and the methods for accomplishing the same will be apparent from the exemplary embodiments described hereinafter. However, the present disclosure is not limited to the exemplary embodiments described hereinafter, but may be embodied in many different forms. The following exemplary embodiments are provided to make the disclosure of the present disclosure complete and to allow those skilled in the art to clearly understand the scope of the present disclosure, and the present disclosure is defined only by the scope of the appended claims. Throughout the specification, the same reference numerals denote the same constituent elements.

In some exemplary embodiments, detailed description of well-known technologies will be omitted to prevent the disclosure of the present disclosure from being interpreted ambiguously. Unless otherwise defined, all terms (including technical and scientific terms) used herein have the same meaning as commonly understood by one of ordinary skill in the art. In addition, throughout the specification, unless explicitly described to the contrary, the word "comprise" and variations such as "comprises" or "comprising" will be understood to imply the inclusion of stated elements but not the exclusion of any other elements. Further, as used herein, the singular forms "a", "an", and "the" are intended to include the plural forms as well, unless the context clearly indicates otherwise.

Further, as used herein, % means wt %, and 1 ppm corresponds to 0.0001 wt %, unless the context clearly indicates otherwise.

Hereinafter, a manufacturing method of an oriented electrical steel sheet according to exemplary embodiments of the present disclosure will be described.

A slab that includes barium (Ba) alone at about 0.005 wt % to about 0.5 wt %, yttrium (Y) alone at about 0.005 wt % to about 0.5 wt %, or a composite of Ba and Y at about 0.005 wt % to about 0.5 wt %, and the remaining portion including iron (Fe) and other inevitably incorporated impurities, is provided.

The slab may include silicon (Si) at about 1.0 wt % to about 4.5 wt %, carbon (C) at less than about 0.005 wt %, aluminum (Al) at less than about 0.005 wt %, nitrogen (N) at less than about 0.0055 wt %, sulfur (S) at less than about 0.0055 wt %, and manganese (Mn) at about 0.01 wt % to about 0.5 wt %.

First, reasons for these components will be described.

Ba and Y serve as grain growth inhibitors to prevent grains of orientations other than Goss grains from growing during secondary recrystallization annealing, thereby improving magnetism of an electrical steel sheet. Ba and Y may be added singly or in combination. When a content of Ba or Y is less than about 0.005 wt %, it is difficult to sufficiently serve as the inhibitor, and when the content thereof is more than about 0.5 wt %, brittleness of the steel sheet increases, thus cracks may occur during rolling.

Si serves to reduce iron loss by increasing specific resistance of a material. When the content of Si is less than about 1.0 wt % in the slab and the electrical steel sheet, the specific resistance thereof may decrease and the iron loss thereof may deteriorate. In addition, when the content of Si of the slab exceeds about 4.5 wt %, it may be difficult to perform cold-rolling. However, after the cold-rolling, since Si powder may be coated or deposited on a surface of the steel sheet and then Si may be diffused into the steel sheet, a content of Si of a final steel sheet may be about 4.5 wt % or more. However, when the Si content of the oriented electrical steel sheet exceeds about 7 wt %, since it is difficult to process the oriented electrical steel sheet for manufacturing a transformer, the Si content thereof may about 7 wt % or less.

C is an austenite stabilizing element added to the slab in an amount of about 0.001 wt % or more such that a coarse columnar structure occurring during a continuous casting process may be miniaturized and slab center segregation of S may be suppressed. In addition, it is possible to promote work hardening of the steel sheet during cold-rolling and to promote nucleation of secondary recrystallization of a {110}<001> orientation in the steel sheet. However, when C exceeds about 0.1 wt %, an edge crack may occur during hot-rolling. Therefore, while the electrical steel sheet is manufactured, a decarburization annealing process is performed, and a C content after the decarburization annealing process may be about 0.0050 wt % or less. Specifically, C may be about 0.0030 wt % or less.

In exemplary embodiments of the present disclosure, since AlN may not be used as a grain growth inhibitor, a content of Al may be positively suppressed. Accordingly, in exemplary embodiments of the present disclosure, Al may be added or controlled to about 0.005 wt %.

Since N forms precipitates such as AlN, (Al, Mn)N, (Al, Si, Mn)N, $Si_3N_4$, and the like, N may not be added or may be controlled to about 0.0055 wt % or less in exemplary embodiments of the present disclosure. Specifically, N may be present at about 0.0035 wt % or less. More specifically, N may be present at about 0.0015 wt % or less.

S is an element having a high solid solution temperature and a high segregation temperature during hot-rolling, and thus it may not be added or may be controlled to 0.0055% or less in exemplary embodiments of the present disclosure. Specifically, S may be present at about 0.0035 wt %. More specifically, S may be present at about 0.0015 wt %.

In the exemplary embodiments of the present disclosure, since MnS may not be used as a grain growth inhibitor, Mn may not be added. However, since Mn is a specific resistance element and improves magnetism, a content of Mn of the slab and of the electrical steel sheet may be about 0.01 wt % or more. However, when Mn exceeds about 0.5 wt %, a phase thereof may be transformed after the secondary recrystallization, thus the magnetism may deteriorate.

Components such as Ti, Mg, Ca, etc. are preferably not added because they react with oxygen in the steel to form oxides. However, they may be controlled to about 0.005 wt % or less in consideration of impurities of the steel.

The slab is then heated. A temperature of heating the slab is not limited, but when the slab is heated at a temperature of about 1280° C. or lower, it is possible to prevent the columnar structure of the slab from being coarsely grown, thereby preventing cracking of the slab in the hot-rolling process. Therefore, the temperature of heating the slab may be about 1000° C. or more and about 1280° C. or less.

When the reheating of the slab is completed, hot-rolling is performed. A temperature of the hot-rolling and a cooling temperature are not particularly limited, and for example, the hot-rolling may be terminated at about 950° C. or less, followed by water cooling, and then spiral-winding at about 600° C.

The hot-rolled steel sheet may be annealed as necessary, or may be cold-rolled without annealing. In the case of annealing the hot-rolled steel sheet, the hot-rolled steel sheet may be heated at a temperature of about 900° C. or higher, soaked, and then cooled so that a hot-rolled structure is made uniform.

The cold-rolling is performed by a reverse mill or a tandem mill, and a cold-rolled steel sheet having a thickness of about 0.1 mm to about 0.5 mm may be manufactured by one cold-rolling process, a plurality of cold-rolling processes, or a plurality of cold-rolling processes including an intermediate annealing process.

Warm-rolling in which a temperature of the steel sheet is maintained at about 100° C. or higher during the cold-rolling may be performed. In addition, a cold-rolled steel sheet having a final thickness of about 0.1 mm to about 0.5 mm may be manufactured through cold-rolling once.

The cold-rolled steel sheet is subjected to primary recrystallization annealing. In the primary recrystallization annealing, primary recrystallization occurs in which decarburization is performed and nuclei of Goss grains are generated.

In the primary recrystallization annealing, the cold-rolled sheet may be maintained at a temperature of about 750° C. or higher for about 30 seconds or more. If the temperature is less than about 750° C., sufficient energy for grain growth may not be provided, and if the energy is provided for less than 30 seconds, the grain growth may be insufficient, thus magnetism may deteriorate.

In addition, in the manufacturing method of the oriented electrical steel sheet according to exemplary embodiments of the present disclosure, after the decarburization annealing process is performed, a nitride annealing process may be omitted. In a conventional manufacturing method of an oriented electrical steel sheet using AlN as a grain growth inhibitor, a nitride annealing process is required for the formation of AlN. However, in the manufacturing method of the oriented electrical steel sheet according to embodiments of the present disclosure, since AlN is not used as a grain growth inhibitor, the nitride annealing process is not required.

After completion of the primary recrystallization annealing, the steel sheet is coated with an annealing separator containing MgO, and is subjected to secondary recrystallization annealing. A soaking temperature during the secondary recrystallization annealing may be about 900° C. to about 1250° C. If the soaking temperature is less than about 900° C., Goss grains may not sufficiently grow and magnetism may deteriorate, while if the soaking temperature exceeds about 1250° C., the grains may coarsely grow such that characteristics of the steel sheet may deteriorate.

In the manufacturing methods of the oriented electrical steel sheet according to embodiments of the present disclosure, after the secondary recrystallization annealing is completed, purification annealing may be omitted.

In a conventional manufacturing method of an oriented electrical steel sheet using MnS and AlN as a grain growth inhibitor, it is necessary to perform a high-temperature purification annealing process to remove precipitates such as AlN and MnS, but in manufacturing methods of the oriented electrical steel sheet according to embodiments of the present disclosure, a purification annealing process may not be necessary.

A base steel sheet of the oriented electrical steel sheet according to embodiments of the present disclosure may include about 0.005 wt % to about 0.5 wt % of Ba alone, about 0.005 wt % to about 0.5 wt % of Y alone, or about 0.005 wt % to about 0.5 wt % of a composite of Ba and Y, the remainder including, or consisting of, Fe and impurities. In this case, the base steel sheet corresponds to a portion excluding a coated layer formed on a surface of the oriented electrical steel sheet.

In addition, the base steel sheet may include about 1.0 wt % to about 7.0 wt % of Si, about 0.005 wt % or less of C, about 0.005 wt % or less of Al, about 0.0055 wt % or less of N, about 0.0055 wt % or less of S, and about 0.01 wt % to about 0.5 wt % of Mn.

Further, the base steel sheet may include about 0.02 wt % to about 0.35 wt % of Ba, Y, or a combination thereof.

In the oriented electrical steel sheet, an area of grains having a grain size of about 2 mm or less may be about 10% or less of a total area of grains of 100%. When the area of the grains having the grain size of about 2 mm or less is more than about 10% of the whole area of the grains of 100%, the grains may not sufficiently grow, thus magnetism may deteriorate.

In addition, in the electrical steel sheet, an average grain size of the grains having the grain size of about 2 mm or more may be about 10 mm or more. When the average grain size of the grains having the grain size of about 2 mm or more is less than about 10 mm, the grains may not sufficiently grow, thus the magnetism may deteriorate.

In addition, in the electrical steel sheet, an angle difference between a <100> plane and a plate plane of the steel sheet may be about 3.5° or less. In this case, the plate plane of the steel sheet means an XY plane of the steel sheet when a rolling direction thereof is an X axis and a width direction thereof is a Y axis. When the angle difference exceeds about 3.5°, the magnetism of the steel sheet may deteriorate.

In addition, in the steel sheet, $B_{10}$, magnetic flux density measured at a magnetic field of about 1000 A/m may be about 1.88 or more. Further, Ba, Y, or a combination thereof may be segregated at grain boundaries by serving as inhibitors.

Hereinafter, exemplary embodiments will be described. However, the following exemplary embodiments are only examples of the present disclosure, and the present disclosure is not limited to the exemplary embodiments.

Exemplary Embodiment 1

A slab including with Si at 3.2 wt %, C at 0.051 wt %, Mn at 0.112 wt %, S at 0.0052 wt %, N at 0.005 wt %, Al at 0.029 wt %, barium (Ba) and yttrium (Y) as shown in Table 1, and the remaining portion including Fe and other inevitably incorporated impurities, was prepared.

The slab was heated at a temperature of 1150° C. for 90 minutes, and then hot-rolled to prepare a hot-rolled steel sheet having a thickness of 2.6 mm. The hot-rolled steel sheet was heated at a temperature of 1050° C. or higher, maintained at 910° C. for 90 seconds, water-cooled, and then pickled. Then, it was cold-rolled to a thickness of 0.29 mm. The cold-rolled steel sheet was heated in a furnace, maintained in a mixed gas atmosphere of hydrogen at 50 vol % and nitrogen at 50 vol %, a dew point temperature of 60° C., and an annealing temperature of 850° C. for 120 seconds, and then subjected to primary recrystallization annealing.

After the primary recrystallization annealing, an amount of carbon was 0.0030 wt %. Then, it was coated with MgO, wound in a coil form, and then subjected to secondary recrystallization annealing.

In final annealing, it was heated to 1200° C. in a mixed gas atmosphere of nitrogen at 25 vol % and hydrogen at 75 vol %, and after reaching 1200° C., it was maintained in a gas atmosphere of hydrogen at 100 vol % for 20 hours, and then cooled.

TABLE 1

| Sample number | Ba content | Y Content | Magnetic flux density (B10, Tesla) | Classification |
|---|---|---|---|---|
| A | 0 | 0 | 1.52 | Comparative material |
| B | 0.06 | 0 | 1.9 | Material according to embodiments of present disclosure |
| C | 0.12 | 0 | 1.92 | Material according to embodiments of present disclosure |
| D | 0.18 | 0 | 1.9 | Material according to embodiments of present disclosure |
| E | 0.6 | 0 | Rolling crack occurrence | Comparative material |
| F | 0 | 0.12 | 1.9 | Material according to embodiments of present disclosure |
| G | 0 | 0.2 | 1.93 | Material according to embodiments of present disclosure |
| H | 0 | 0.3 | 1.9 | Material according to embodiments of present disclosure |
| I | 0 | 0.7 | Rolling crack occurrence | Comparative material |
| J | 0.002 | 0.002 | 1.52 | Comparative material |
| K | 0.08 | 0.03 | 1.94 | Material according to embodiments of present disclosure |
| L | 0.6 | 0.03 | 1.61 | Comparative material |
| M | 0.04 | 0.46 | 1.91 | Material according to embodiments of present disclosure |
| N | 0.12 | 0.38 | 1.91 | Material according to embodiments of present disclosure |
| O | 0.1 | 0.6 | 1.56 | Comparative material |

As shown in Table 1, the magnetism of the inventive material in which contents of Ba and Y are controlled in a range of 0.005% to 0.5% as a range of the present disclosure is superior to that of the comparative material.

Exemplary Embodiment 2

A slab including Si at 3.2 wt %, Cat 0.051 wt %, Mn at 0.112 wt %, S at 0.0052 wt %, N at 0.005 wt %, Al at 0.029 wt %, barium (Ba) and yttrium (Y) as shown in Table 2, and the remaining portion including Fe and other inevitably incorporated impurities, was prepared.

The slab was heated at a temperature of 1150° C. for 90 minutes, and then hot-rolled to prepare a hot-rolled steel sheet having a thickness of 2.6 mm. The hot-rolled steel sheet was heated at a temperature of 1050° C. or higher, maintained at 910° C. for 90 seconds, water-cooled, and then pickled. Then, it was cold-rolled to a thickness of 0.29 mm. The cold-rolled steel sheet was heated in a furnace, maintained in a mixed gas atmosphere of hydrogen at 50 vol % and nitrogen at 50 vol %, a dew point temperature of 60° C., and an annealing temperature of 850° C. for 120 seconds, and then subjected to primary recrystallization annealing. After the primary recrystallization annealing, an amount of carbon was 0.0030 wt %. Then, it was coated with MgO, wound in a coil form, and then subjected to secondary recrystallization annealing.

In final annealing, it was heated to 1200° C. in a mixed gas atmosphere of nitrogen at 25 vol % and hydrogen at 75 vol %, and after reaching 1200° C., it was maintained in a gas atmosphere of hydrogen at 100 vol % for 20 hours, and then cooled.

TABLE 2

| Ba content (wt %) | Y content (wt %) | Area ratio of grains of 1 mm or less (%) | Average size of grains of 1 mm or more (mm) | Magnetic flux density (B10, Tesla) |
|---|---|---|---|---|
| 0 | 0 | 100 | — | 1.53 |
| 0.08 | 0.03 | 2 | 25 | 1.92 |

As shown in Table 2, in the electrical steel sheet according to embodiments of the present disclosure, the area of the grains having the size of 1 mm or less was 10% or less, and the average size of the grains having the size of 1 mm or more was 10 mm or more.

While exemplary embodiments of the present disclosure have been described hereinbefore with reference to the accompanying drawings, it will be understood by those skilled in the art that various changes in form and details may be made thereto without departing from the technical spirit and essential features of the present disclosure.

Therefore, the embodiments described above are only examples and should not be construed as being limitative in any respects. The scope of the present disclosure is determined not by the above description, but by the following claims, and all changes or modifications from the spirit, scope, and equivalents of claims should be construed as being included in the scope of the present disclosure.

The invention claimed is:

1. An oriented electrical steel sheet comprising

Ba at about 0.005 wt % to about 0.5 wt % inclusive, or a composite of Ba and Y at about 0.005 wt % to about 0.5 wt % inclusive, wherein Ba and Y are included in the composite of Ba and Y, and the remainder including Fe and impurities, based on 100 wt % of a total composition of a base steel sheet thereof, wherein the base steel sheet thereof includes:

Si at about 1.0 wt % to about 7.0 wt % inclusive,

C at about greater than 0 wt % and 0.0050 wt % or less,

Al at about greater than 0 wt % and 0.005 wt % or less,

N at about greater than 0 wt % and 0.0055 wt % or less, and

S at about greater than 0 wt % and 0.0055 wt % or less, and Mn at about 0.01 wt % to about 0.5 wt % inclusive.

2. The oriented electrical steel sheet of claim 1, wherein an area of grains of the electrical steel sheet having a grain size of about 2 mm or less is about 10% or less with respect to 100% of an area of total grains.

3. The oriented electrical steel sheet of claim 2, wherein an average size of grains of the electrical steel sheet having a grain size of about 2 mm or more is about 10 mm or more.

4. The oriented electrical steel sheet of claim 3, wherein an angular difference between a <100> plane and a plate plane of the electrical steel sheet is about 3.5° or less.

5. The oriented electrical steel sheet of claim 4, wherein $B_{10}$ corresponding to magnetic flux density of the electrical steel sheet measured at a magnetic field of about 1000 A/m is about 1.88 or more.

6. The oriented electrical steel sheet of claim 1, wherein Ba, Y, or a combination thereof is segregated at grain boundaries of the electrical steel sheet.

7. The oriented electrical steel sheet of claim 1, comprising a composite of Ba and Y at about 0.005 wt % to about 0.5 wt % inclusive, wherein Ba and Y are both included in the composite of Ba and Y.

8. The oriented electrical steel sheet of claim 7, wherein Ba is segregated at grain boundaries of the electrical steel sheet.

9. A manufacturing method of an oriented electrical steel sheet, comprising: heating a slab including Ba at about 0.005 wt % to about 0.5 wt % inclusive, Y at about 0.005 wt % to about 0.5 wt % inclusive, or a composite of Ba and Y at about 0.005 wt % to about 0.5 wt % inclusive, the remaining portion including Fe and other inevitably incorporated impurities, based on 100 wt % of a total composition of the slab;

producing a hot-rolled steel sheet by hot-rolling the slab;

producing a cold-rolled steel sheet by cold-rolling the hot-rolled steel sheet;

performing primary recrystallization annealing for the cold-rolled steel sheet; and performing secondary recrystallization annealing for an electrical steel sheet for which the primary recrystallization annealing is completed, thereby producing the oriented electrical steel sheet of claim 1.

10. The manufacturing method of the oriented electrical steel sheet of claim 9, wherein the slab includes Si at about 1.0 wt % to about 4.5 wt % inclusive, C at about 0.001 wt % to about 0.1 wt % inclusive, Al at about 0.005 wt % or less, N at about 0.0055 wt % or less, S at about 0.0055 wt % or less, and Mn at about 0.01 wt % to about 0.5 wt % inclusive.

11. The manufacturing method of the oriented electrical steel sheet of claim 9, wherein a slab heating temperature in the heating of the slab is about 1280° C. or lower.

12. The manufacturing method of the oriented electrical steel sheet of claim 11, wherein a soaking temperature in the secondary recrystallization annealing is about 900° C. to about 1250° C. inclusive.

13. The manufacturing method of the oriented electrical steel sheet of claim 12, wherein after the hot-rolling, hot-rolled steel sheet annealing is performed.

14. The manufacturing method of the oriented electrical steel sheet of claim 13, wherein in the primary recrystallization annealing, the cold-rolled steel sheet is maintained at a temperature of 750° C. or higher for about 30 seconds or more.

15. An oriented electrical steel sheet comprising

Ba at about 0.005 wt % to about 0.5 wt % inclusive, and the remainder including Fe and impurities, based on 100 wt % of a total composition of a base steel sheet thereof, wherein the base steel sheet thereof includes:

Si at about 1.0 wt % to about 7.0 wt % inclusive,

C at about greater than 0 wt % and 0.0050 wt % or less,

Al at about greater than 0 wt % and 0.005 wt % or less,

N at about greater than 0 wt % and 0.0055 wt % or less,

S at about greater than 0 wt % and 0.0055 wt % or less, and

Mn at about 0.01 wt % to about 0.5 wt % inclusive.

16. The oriented electrical steel sheet of claim 15, wherein Ba is segregated at grain boundaries of the electrical steel sheet.

* * * * *